US006811462B1

(12) United States Patent
Kenneally

(10) Patent No.: US 6,811,462 B1
(45) Date of Patent: Nov. 2, 2004

(54) GARMENT INTERIOR BRA

(76) Inventor: Caroline R. Kenneally, 157 W. 85 St. Apt. 3B, New York, NY (US) 10024

( * ) Notice: Subject to any disclaimer, the term of this patent is extended or adjusted under 35 U.S.C. 154(b) by 0 days.

(21) Appl. No.: 10/304,876

(22) Filed: Nov. 26, 2002

(51) Int. Cl.[7] ..... A41C 3/00
(52) U.S. Cl. ..... 450/30; 2/67; 450/31
(58) Field of Search ..... 2/1, 67, 69, 78.1–78.3, 2/73; 450/7–11, 60, 62, 65, 70, 66, 17, 23, 26, 28, 30, 31–33, 59, 63, 78

(56) References Cited

U.S. PATENT DOCUMENTS

| | | | | | |
|---|---|---|---|---|---|
| 1,927,018 | A | * | 9/1933 | Bloom | 2/73 |
| 1,990,322 | A | * | 2/1935 | Goldberg | 2/73 |
| 2,009,620 | A | * | 7/1935 | Jackson | 2/73 |
| 2,268,781 | A | * | 1/1942 | Slotoroff | 2/67 |
| 2,493,179 | A | | 1/1950 | Wittenberg | |
| 2,592,265 | A | * | 4/1952 | Fyffe | 2/67 |
| 2,595,139 | A | * | 4/1952 | Hart | 2/73 |
| 2,863,460 | A | | 12/1958 | Monroe | |
| 3,212,503 | A | * | 10/1965 | Gorman | 2/73 |
| 3,255,754 | A | | 6/1966 | Brumberger | |
| 3,311,112 | A | * | 3/1967 | Murray | 2/86 |
| 4,100,621 | A | * | 7/1978 | Ettipio | 2/114 |
| 4,564,015 | A | * | 1/1986 | Friedman | 450/31 |
| 4,798,557 | A | * | 1/1989 | Scott | 450/31 |
| 5,033,986 | A | | 7/1991 | Feigenbaum | |
| 5,478,278 | A | | 12/1995 | Greenblatt | |
| 6,336,840 | B2 | | 1/2002 | Heroff | |
| 6,443,805 | B1 | * | 9/2002 | Kirkwood | 450/31 |

* cited by examiner

*Primary Examiner*—Gloria M. Hale
(74) *Attorney, Agent, or Firm*—Brenda Pomerance

(57) ABSTRACT

An activewear garment includes a removable bra portion, so that the amount and size of bra support can be easily adapted to the wearer. The activewear garment includes a back band which, when coupled to the bottom band of the bra portion, forms a continuous band around the chest of the wearer. The back band and the bottom band are formed of material having substantially the same elasticity. When the bra portion is fastened in the garment, an integral bra is formed wherein the back band of the garment also serves as the back band of the integral bra.

19 Claims, 13 Drawing Sheets

GARMENT INTERIOR BRA

BACKGROUND OF THE INVENTION

The present invention relates to a garment with a removable interior garment, and more particularly, is directed to an activewear garment with a removable bra.

Designing a women's activewear garment is a difficult problem. Women's breasts have different sizes, shapes and separations. The amount of desired breast support varies by wearer and by type of activity. While support is necessary, it is also highly desirable to look "natural"; thus, the bra should be unobtrusive. A further challenge is that the garment must be economic to manufacture.

A sleeveless top such as a camisole or tank style of activewear garment will now be discussed. It will be appreciated that this discussion also applies to the upper body portion of a women's leotard or one-piece swimsuit.

Generally, when the same feature appears on the left and right sides of a garment, only one instance is numbered, to avoid cluttering the illustration.

FIGS. 1, 2 and 3 show views of a tank top with built-in underwire bra. The exterior of garment 1 appears smooth, as shown in FIG. 3. FIG. 1 shows a view of the interior portion of the front with the back opened for illustration; the actual garment has a continuous back. Liner 2 extends along the front of shoulder strap 11 from the shoulder seam of shoulder strap 11 to slightly under the wearer's bust line. The top and sides of liner 2 are permanently sewn into the shoulder seams of strap 11, the side seams of strap 11, neckline seam 8, and garment side seams 7. The bottom of liner 2 is sewn to elastic band 4. Elastic band 4 extends horizontally across the wearer's chest at slightly below her heartline. The ends of elastic band 4 are permanently sewn into garment side seams 7. At the center of liner 2, at the top of the wearer's heart, fastening patch 6 is sewn to liner 2. Fastening patch 6 permanently anchors the inner ends of underwires 5. The outer ends of underwires 5 are permanently sewn into the armhole seam formed at the outer side of shoulder strap 11. Panel 3 has a top edge formed by wrapping its material around underwires 5 and a bottom edge sewn to elastic band 4; the sides of panel 3 are permanently sewn into side seams 7. Side seam 7 has selvedge 9.

FIG. 2 shows that, in use, the wearer's breast mass is supported by panel 3, specifically in the pouch area formed by panel 3 and liner 2, when underwire 5 is pulled away from liner 2.

FIGS. 4, 5 and 6 show views of a swimsuit with a removable bra portion, reproduced from U.S. Pat. No. 5,478,278 to Irwin Greenblatt. FIG. 5 shows a bra portion having vertical extensions 40 bearing fastening material 60. Attached to side extension 50 is fastening material 70. FIG. 4 shows swimsuit 20 having shoulder straps 22 bearing fastening material 80 adapted to couple to fastening material 60 on the shoulder extensions 40 of the bra portion. Swimsuit 20 also has side seams 24 bearing panels of fastening material 90 adapted to couple to fastening material 70 on the side extensions 50 of the bra portion. The fastening material consists of hook and loop fasteners stitched to the swimsuit and bra portion, but may be any suitable fastening material or connectors. FIG. 6 shows another bra portion lacking vertical extensions and thus being suitable for a strapless swimsuit such as a "bandeau"; this bra portion has side extensions 350 bearing fastening material 370. When the bra portion is inserted, the back portion of the suit functions as the back of the bra portion. That is, the inserted bra portion and the back of the suit form a bra.

FIGS. 7 and 8 show views of a halter top with a removable bra portion, reproduced from U.S. Pat. No. 2,493,179 to Margaret H. Wittenberg. As shown in FIG. 8, bra portion 10B has sides with buttonholes 40B, for detachably securing the sides of the bra portion to garment side extensions 46 bearing buttons 38B. The bra portion has loops 46 at the top of the side portions for detachably securing the bra portion to garment hooks 48. The garment hooks 48 are part of buckles 50 carried by garment interior straps 52 stitched inside garment front portion 18B. Garment halter strap 54 is terminated at the top ends of garment interior straps 52. When the bra portion is secured to the garment, the back of the garment also functions as the back of the bra, to eliminate the need to provide a back portion to the bra portion, and improving the appearance of the garment on the wearer.

FIGS. 9 and 10 show views of a camisole with built-in underwire bra. This camisole has a very low back. Underwire 71 is located in a channel formed by stitching garment 60. Top lining 68 is fixed between the neck edge and contour seam 70. Bottom lining 69 is fixed between contour seam 70 and underwire 71. Top lining 68 is formed from the same fabric as the main body of garment 60. Bottom lining 69 is a lighter weight stretchy fabric. Piece 72 is formed of a non-stretchy fabric and is permanently sewn into the neck edge of the garment at its top, and at its side, to the center parts of underwires 71. The bottom edge of piece 72 is loose.

FIGS. 11–14 show views of a camisole with built-in cookies. FIG. 13 shows cookie 93, a foam pad for wearing at the base of a breast to increase apparent breast size due to its own volume and by pushing the breast up thereby creating more cleavage. Liner 80 is permanently sewn at its top in the neck edge of the camisole, at its sides in cookie contour seams 87 and at its base into horizontal contour seam 94. Elastic band 92 extends around the inner circumference of the camisole. The top of elastic band 92 is sewn to the bottom of shelf piece 91. At the back of the camisole, the top of shelf piece 92 is sewn in the top edge of the camisole. At the front of the camisole, the top of shelf piece 92 is sewn into horizontal contour seam 94. Cookie inner piece 89 extends from the junction of horizontal contour seam 94 and cookie contour seam 87 along about ¾ of contour seam 87 and is sewn into these seams; the outer side edge of cookie inner piece 89 is loose. Cookie outer piece 90 is sewn at its outer side edge to the side of the camisole, at its top edge to cookie contour seam 87 and at its bottom edge to horizontal contour seam 94. Cookie outer piece 90 extends along about ⅓ of the cookie contour seam 87. The inner side edge of cookie outer piece 90 is loose. Cookie outer piece 90 overlaps cookie inner piece 89 such that the loose edges can be pulled apart to insert cookie 93 and then returned to their flat state to create a retaining pocket for cookie 93. Horizontal contour seam 94 and cookie contour seams 87 are visible on the front of the camisole.

FIGS. 15 and 16 show views of a camisole with built-in shelf bra. The camisole has a continuous back. The top of liner 103 is sewn into neck seam 102 and top back seam 105. The bottom of liner 103 is sewn to elastic band 104, forming a floating shelf bra.

FIGS. 17 and 18 show views of another camisole with built-in shelf bra. This camisole also has a continuous back. The top of liner 113 is sewn into the camisole's neck seam, while the sides of liner 113 are sewn into sides 116 of the camisole. The bottom of liner 113 is sewn into horizontal chest seam 1114, forming a completely built-in shelf bra.

FIGS. 19 and 20 show views of yet another camisole with built-in shelf bra. This camisole has a continuous back. The top of liner 125 is sewn into the bottom seam of v-neck portions 123 and 124. The sides of liner 125 are sewn into sides 127 of the camisole. The bottom of liner 125 is sewn to elastic band 126, which is loose in its main portion although sewn at its side edges into sides 127 of the camisole.

None of these garments provide adequate support for high impact activity across a range of breast sizes. Accordingly, there is a need for an improved women's activewear garment.

SUMMARY OF THE INVENTION

In accordance with an aspect of this invention, there is provided a women's activewear garment comprising an outer garment and a bra portion. The outer garment has a back band with back fasteners at the side edges of the back band. The portion has a bottom band with bra fasteners as the side edges of the bottom band. The bra fasteners couple with respective ones of the back fasteners to create a continuous band around the chest of a wearer. The back band of the outer garment and the bottom band of the bra portion are formed of material having substantially the same elasticity.

It is not intended that the invention be summarized here in its entirety. Rather, further features, aspects and advantages of the invention are set forth in or are apparent from the following description and drawings.

BRIEF DESCRIPTION OF THE DRAWINGS

In the drawings, like elements are indicated by the same reference number in different drawings.

DETAILED DESCRIPTION

An activewear garment according to the present invention includes a removable bra portion, so that the amount and size of bra support can be easily adapted to the wearer. In contrast, bras that are built in to activewear garments cannot be easily modified in either size of amount of support.

The activewear garment includes a back band which, when coupled to the bottom band of the bra portion, forms a continuous band around the chest of the wearer. The back band and the bottom band are formed of material having substantially the same elasticity. When the bra portion is fastened in the garment, an integral bra is formed wherein the back band of the garment also serves as the back band of the integral bra. In contrast, when the back band of the garment has a different elasticity than the bottom band of the bra portion, such as due to being formed of a different material or being of the same material but a different width, the resulting integral bra is not uniformly anchored and more readily slips during active movement, thus providing less support.

In some embodiments such as leotards, the back band of the garment extends across the back of the wearer while the panty portion has a separate top edge serving as the top of a low scoop back. This enables greater visibility of the wearer's back. Dancers typically want their back to be visible, and also want firm breast support, possibly with breast size augmentation. Conventional activewear garments do not meet the challenging constraints created by dancers, whereas the present inventive garment does satisfy even demanding dancers.

A sleeveless top such as a camisole style of activewear garment will now be discussed. It will be appreciated that this discussion also applies to the upper body portion of a women's leotard or one-piece swimsuit.

Figure 1:
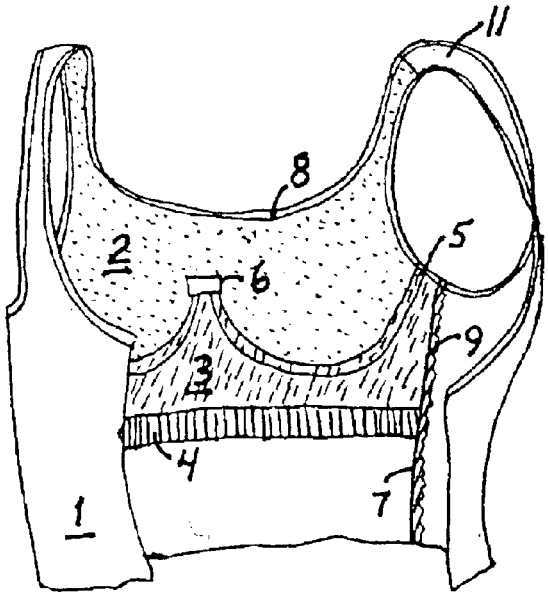
FIG. 1 (Prior Art)
FIGS. 1, 2 and 3 show Prior art views of a tank top with built-in underwire bra.
Figure 2:
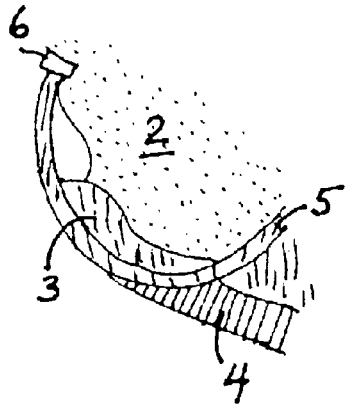
FIG. 2 (Prior Art)
Figure 3:
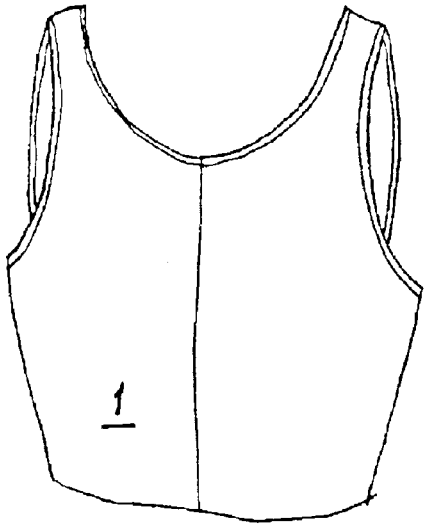
FIG. 3 (Prior Art)
Figure 4:
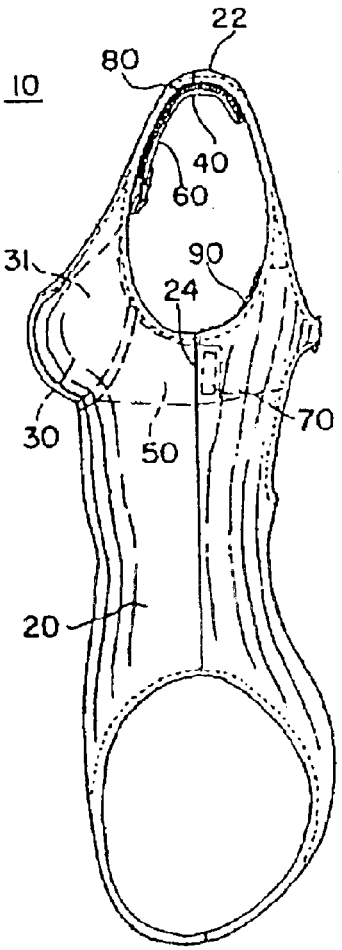
FIG. 4 (Prior Art)
FIGS. 4, 5 and 6 show Prior Art views of a swimsuit with a removable bra portion.
Figure 5:
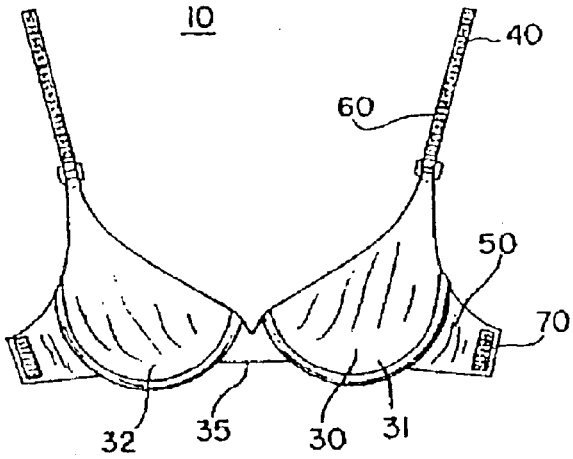
FIG. 5 (Prior Art)
Figure 6:
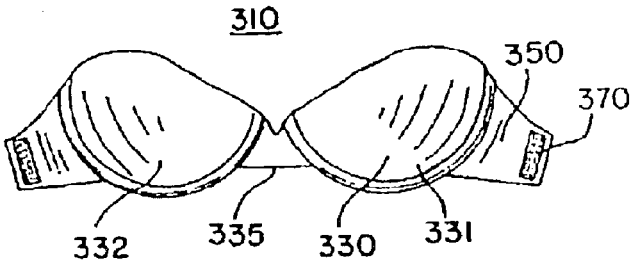
FIG. 6 (Prior Art)
Figure 7:
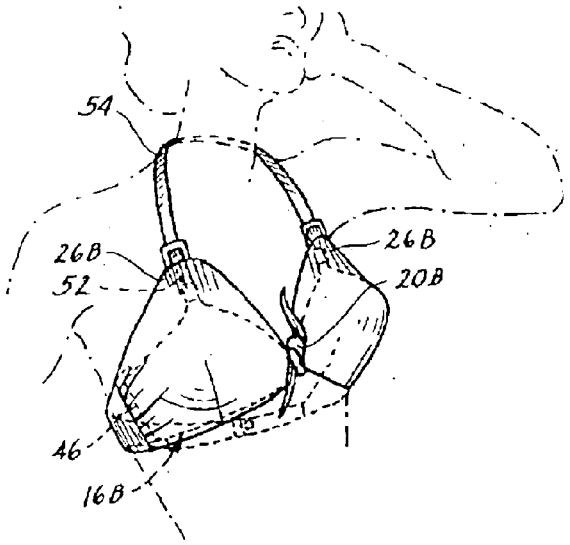
FIG. 7 (Prior Art)
FIGS. 7 and 8 show Prior Art views of a halter top with a removable bra portion.
Figure 8:
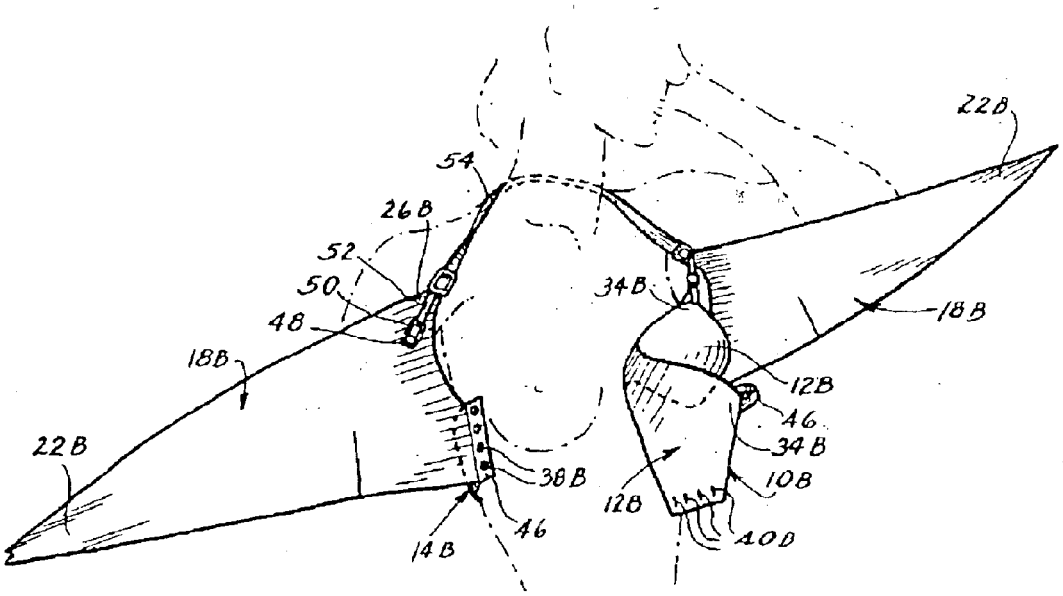
FIG. 8 (Prior Art)
Figure 9:
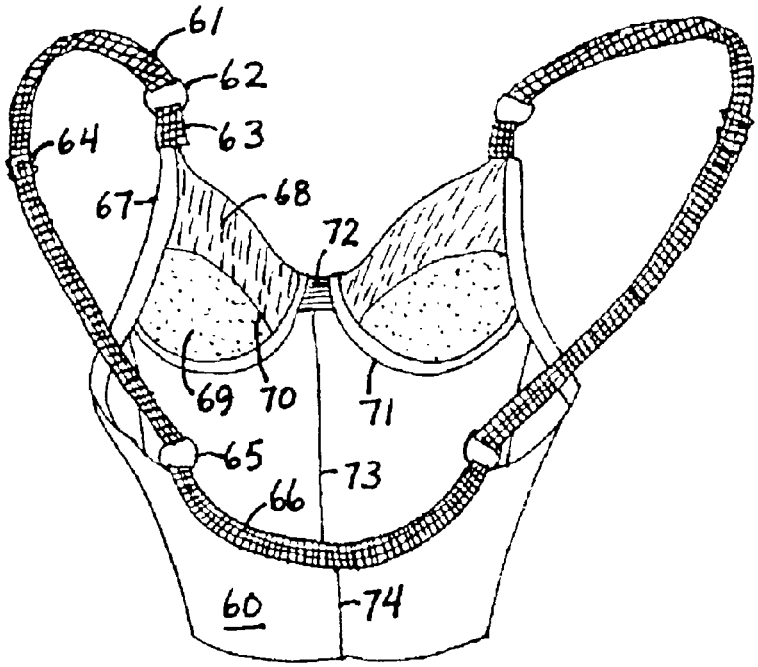
FIG. 9 (Prior Art)
FIGS. 9 and 10 show Prior Art views of a camisole with built-in underwire bra.
Figure 10:
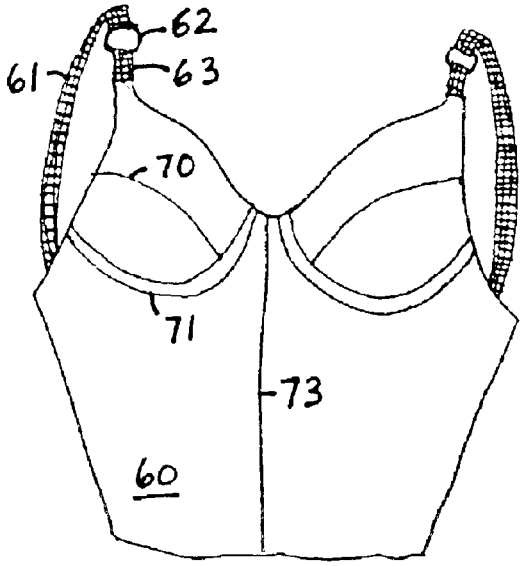
FIG. 10 (Prior Art)
Figure 11:
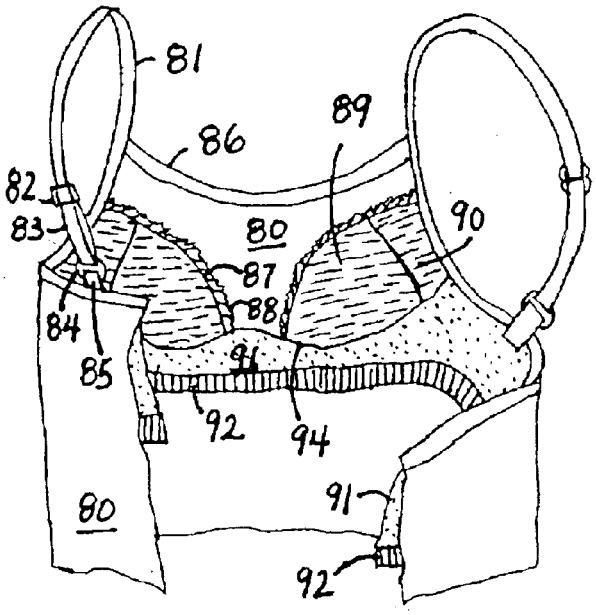
FIG. 11 (Prior Art)
FIGS. 11–14 show Prior Art views of yet another camisole with built-in cookies.
Figure 12:
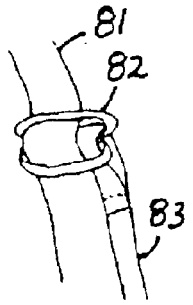
FIG. 12 (Prior Art)
Figure 14:
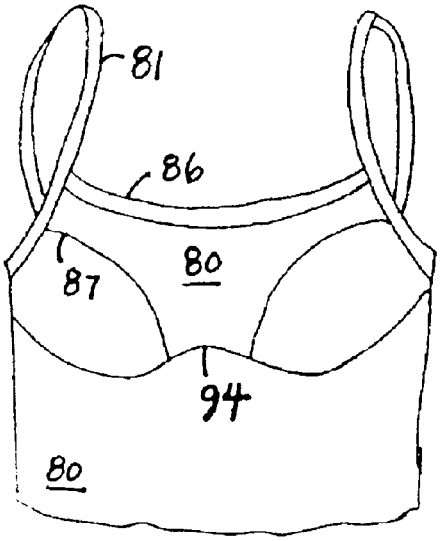
FIG. 14 (Prior Art)
Figure 13:
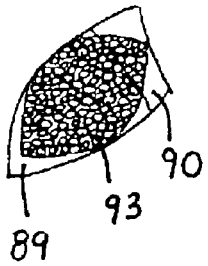
FIG. 13 (Prior Art)
Figure 15:
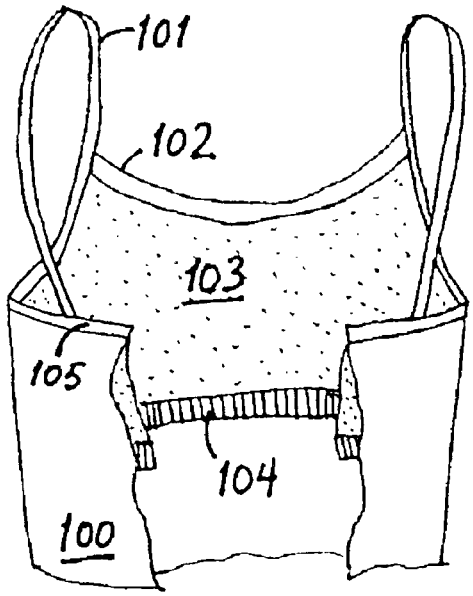
FIG. 15 (Prior Art)
FIGS. 15 and 16 show Prior Art views of a camisole with built-in shelf bra.
Figure 16:
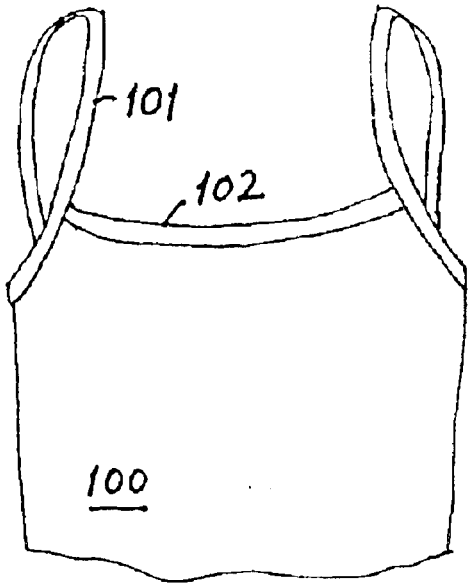
FIG. 16 (Prior Art)
Figure 17:
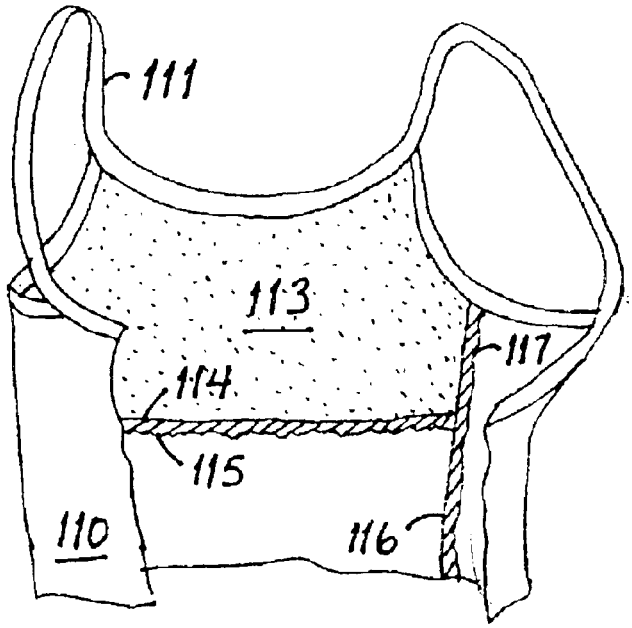
FIG. 17 (Prior Art)
FIGS. 17 and 18 show Prior Art views of another camisole with built-in shelf bra.
Figure 18:
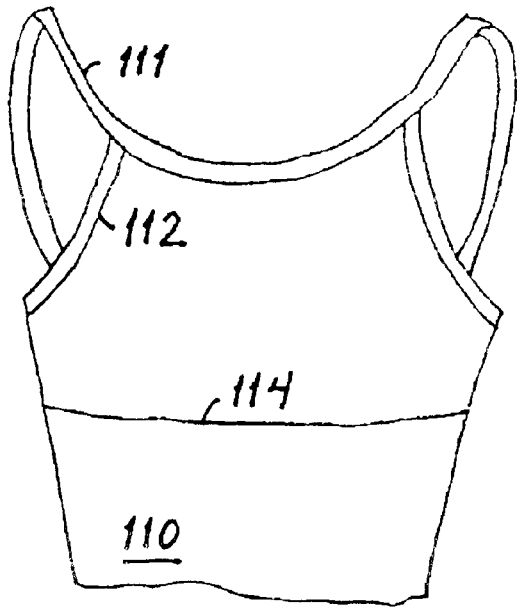
FIG. 18 (Prior Art)
Figure 19:
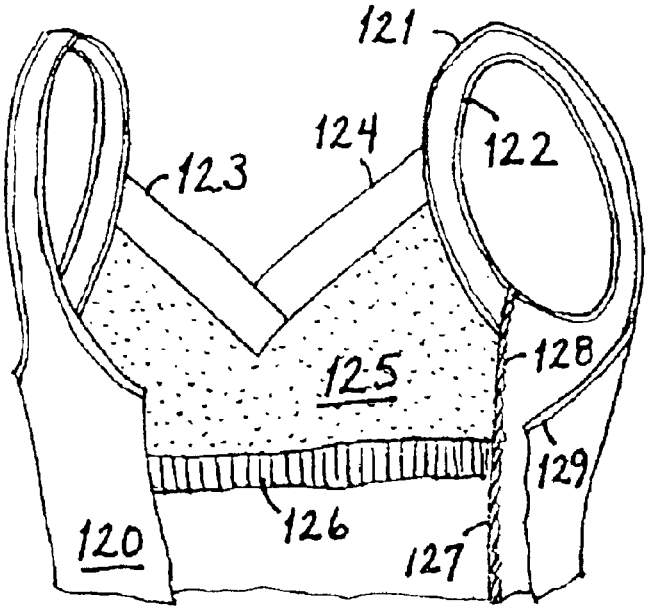
FIG. 19 (Prior Art)
FIGS. 19 and 20 show Prior Art views of yet another camisole with built-in shelf bra.
Figure 20:
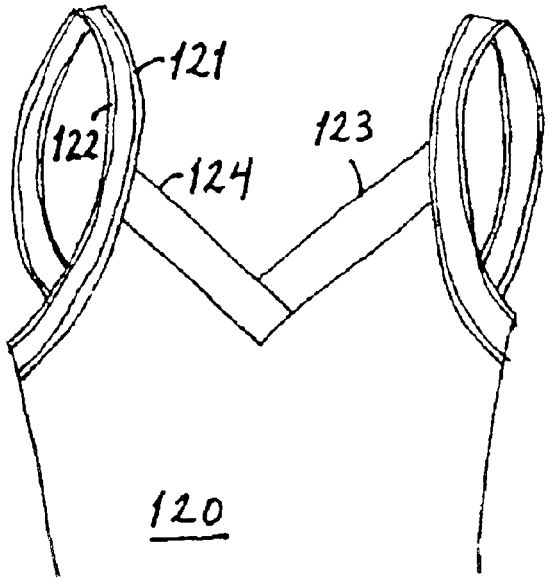
FIG. 20 (Prior Art)
Figure 21:
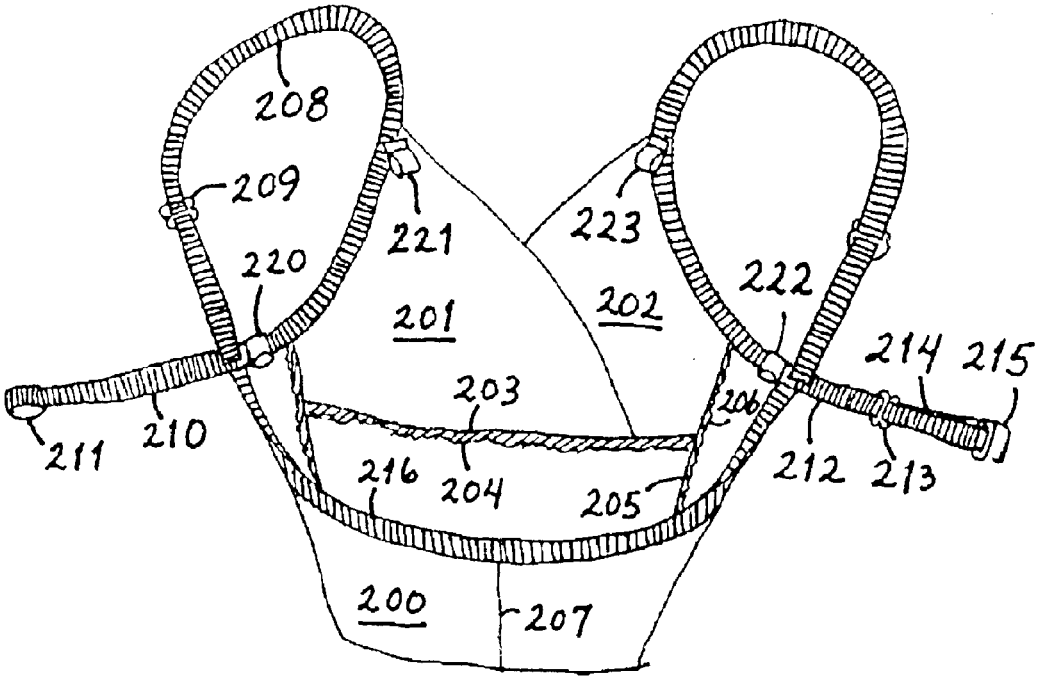
FIGS. 21–25 show views of a camisole with removable bra portion.
Figure 22:
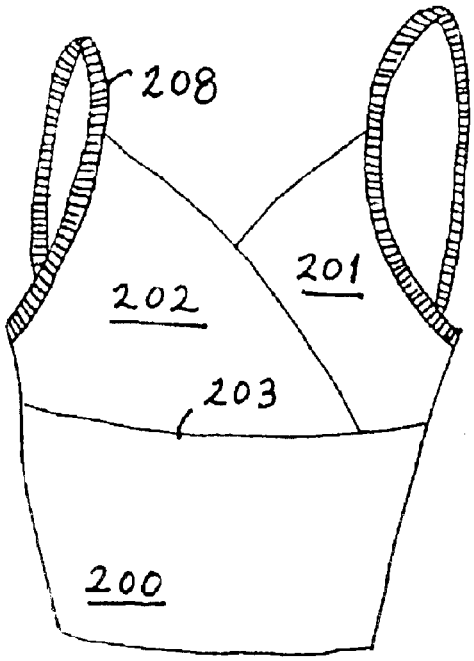
Figure 23:
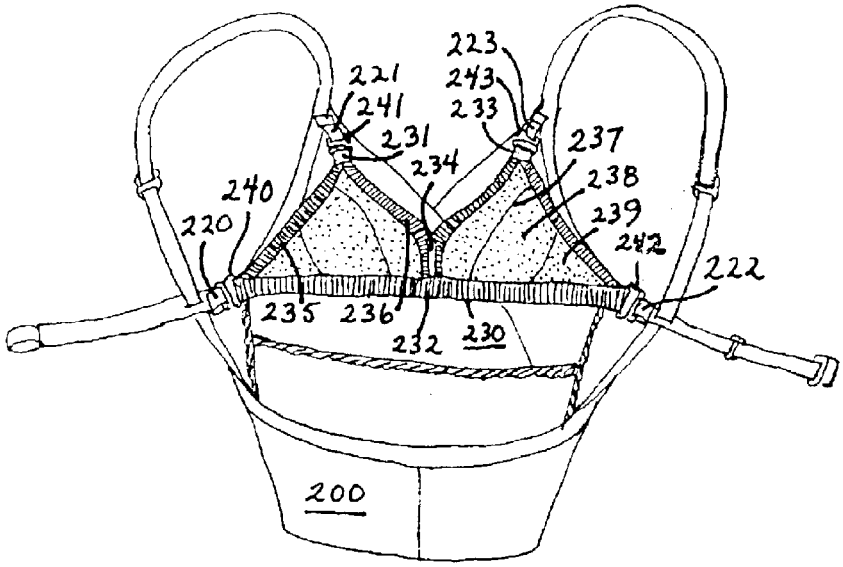
Figure 24:
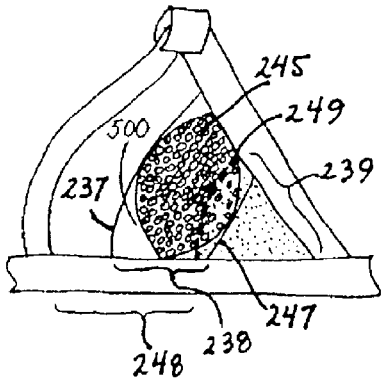
Figure 25:
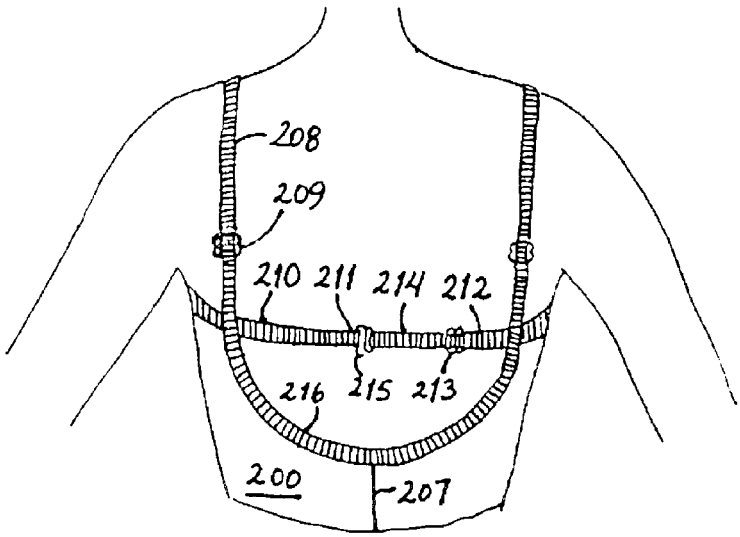

FIGS. 21–25 show views of a camisole with removable bra portion. FIG. 22 shows a front view of outer garment 200, while FIG. 25 shows a back view of outer garment 200, as worn. FIG. 21 shows the interior of the front of outer garment 200, without bra portion 230. FIG. 23 shows the interior of the front of outer garment 200 with bra portion 230 inserted. Generally, when the same feature appears on the left and right sides of a garment, only one instance is numbered, to avoid cluttering the illustration.

FIG. 21 shows outer garment 200 having left chest portion 201, right chest portion 202, horizontal chest seam 203, chest selvedge 204, side seams 205, side selvedges 206, center back seam 207, shoulder straps 208, sliders 209 and 213, bands 210, 212, 214, loop 211, hook 215, scoop back band 216, back fasteners 220, 222 and chest fasteners 221, 223. Outer garment 200 can be worn as shown in FIG. 21, that is, without a bra support portion.

Back fasteners 220, 222 are approximately at the location where bands 210, 212 meet the side edges of the garment. Chest fasteners 221, 223 are approximately at the location where shoulder straps 208 meet the front of the garment.

In another embodiment, the garment shown in FIG. 21 is actually a leotard or swimsuit, and scoop back band 216 forms the top of the back of the panty portion of the leotard or swimsuit.

In the embodiment of FIG. 21, shoulder straps 208, bands 210, 212, 214 and scoop back band 216 are formed of elastic trim having a relatively thin width, such as 0.5 inches. These elements may be the same color as garment 200 or a contrasting color. These elements may be formed of fabric having matte reflectivity or shiny reflectivity. Although these elements are all formed of the same elastic trim in FIG. 21, in other embodiments, the elements may be formed of different size and/or color and/or elasticity trim.

Bands 210, 214, 212 form an adjustable back band of garment 200. More specifically, slider 213 is coupled to band 214 to enable adjustment of the extent of the length of band 214 that is used as a single strip or a doubled strip, thus adjusting the length of band 214. Slider 213 is widely used in garments such as lingerie and need not be further described herein.

Shoulder straps 208 extend over the wearer's shoulders and terminate at the back band formed by bands 210, 214, 212. The length of shoulder straps 208 can be adjusted by moving sliders 209, which operate in the same manner as slider 213.

FIG. 23 shows bra portion 230, including anchors 231, 233, bottom band 232 having hooks 240 and 242 at its outer edges, overlay piece 234, cup outer bands 235, cup inner bands 236, contour seam 237, cup inner piece 238 having outer side edge 247, cup outer piece 239 having inner side edge 249, and hooks 241 and 243 respectively attached to anchors 231 and 233.

Cup inner piece 238 and cup outer piece 239 form a cup of bra portion 230. Anchors 231 and 233 are respectively located at the top of the cups of bra portion 230. Hook 241 and anchor 231 form a first strap fastener. Hook 243 and anchor 233 form a second strap fastener.

In this embodiment, bottom band 232 is formed of the same elastic trim as shoulder straps 203, bands 210, 212, 214 and scoop back band 216. In other embodiments, bottom band 232 and bands 210, 212, 214 are formed of material having substantially the same elasticity, but not necessarily exactly the same material, for instance, the color may differ or the width may be slightly different.

As shown in FIG. 24, cup outer piece 239 overlaps cup inner piece 238 such that the loose edges 249 and 247 can be pulled apart to insert cookie 245 and then returned to their flat state to create a retaining pocket 500 for cookie 245. Cookie 245 is formed of a non-stretchy lightweight high volume material such as foam or a lightweight outer shell containing batting, and is used to increase the apparent breast size of the wearer. Each of the left and right sides of bra portion 230 has a cookie retaining pocket. Bra portion 230 may be used with or without cookies inserted in the cookie retaining pockets.

In other embodiments, cookie 245 is an air pocket type of insert, a fluid filled type of insert, or a slab of material such as silicone or rubber.

When bra portion 230 is inserted into garment 200, hooks 240, 241, 242, 243 of bra portion 230 are respectively coupled to fasteners 220, 221, 222, 223 of garment 200.

After coupling, bottom band 232 and the back band formed of bands 210, 212, 214 form a continuous band around the chest of the wearer.

After coupling, an integral bra is formed from bra portion 230, bands 210, 212, 214 and shoulder straps 208. Bands 210, 212, 214 and shoulder straps 208 also serve as the visible back band and shoulder straps of the activewear garment when it is worn.

In this embodiment, shoulder straps 208, cup outer bands 235 and cup inner bands 236 are formed of the same elastic band material. When assembled into an integral bra, straps 208 and bands 235, 236 cooperate to evenly distribute stress from the weight of the wearer's breast across the integral bra.

Figure 26:
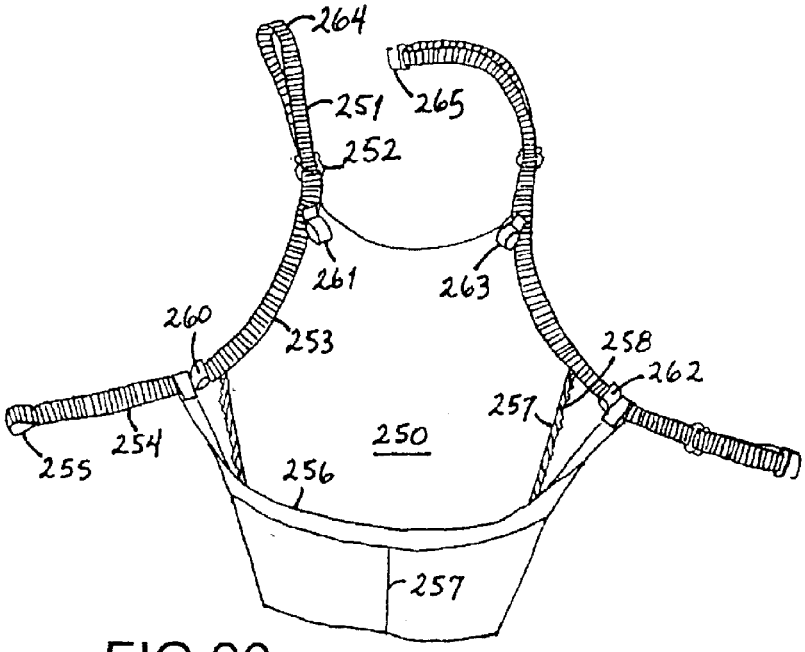
FIG. 26 shows a view of a halter top configured for a removable bra portion.

FIG. 26 shows a view of a halter top configured for a removable bra portion. Garment 250 of FIG. 26 is an outer garment that is generally similar to outer garment 200 of FIG. 21. Shoulder straps 251 of garment 250 are actually loops whose length is adjustable by moving sliders 252. One of straps 251 has loop 264 at its topmost end while the other of straps 251 has hook 265 at its topmost end. Fasteners 260, 261, 262, 263 are adapted to couple with bra portion 230 in like manner as fasteners 220, 221, 222, 223 of FIG. 21.

In a variation, the shoulder strap is one continuous strap positioned around the back of the wearer's neck and having a slider for adjusting its length.

Figure 27:
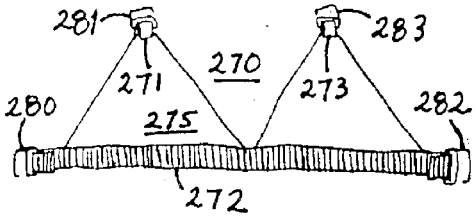
FIGS. 27 and 28 show different removable bra portions.

FIG. 27 shows bra portion 270 that serves as a shelf bra when coupled to garment 200 or 250. Bra portion 270 includes anchors 271, 273, bottom band 272 having hooks 280 and 282 at its outer edges, cups 275, and hooks 281 and 283 respectively attached to anchors 271 and 273. Cups 275 are shown as triangles of preferably stretchy material. In other embodiments, cups 275 may be one continuous piece of stretchy material. Parts of bra portion 270 that correspond to parts of bra portion 230 function in like manner and are not described for brevity.

Figure 28:
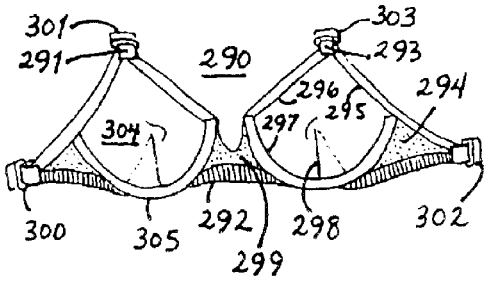

FIG. 28 shows bra portion 290 that serves as an underwire bra when coupled to garment 200 or 250. Bra portion 290 includes anchors 291, 293, bottom band 292 having hooks 300 and 302 at its outer edges, side panels 294, central panel 299, cup outer bands 295, cup inner bands 296, cups 304 having respective darts 298, underwires 305, and hooks 301 and 303 respectively attached to anchors 291 and 293. Parts of bra portion 290 that correspond to parts of bra portion 230 function in like manner and are not described for brevity.

In a variation, bra portion 290 has curved seams instead of a dart.

In this embodiment, cups 304 are formed of a stretchy material. In other embodiments, cups 304 are formed of a substantially stable material. In yet other embodiments, cups 304 are formed of an outer layer and an inner layer with a layer of foam sandwiched therebetween, to increase apparent breast size and/or to prevent the wearer's nipples from showing when the activewear garment is worn.

Figure 29:
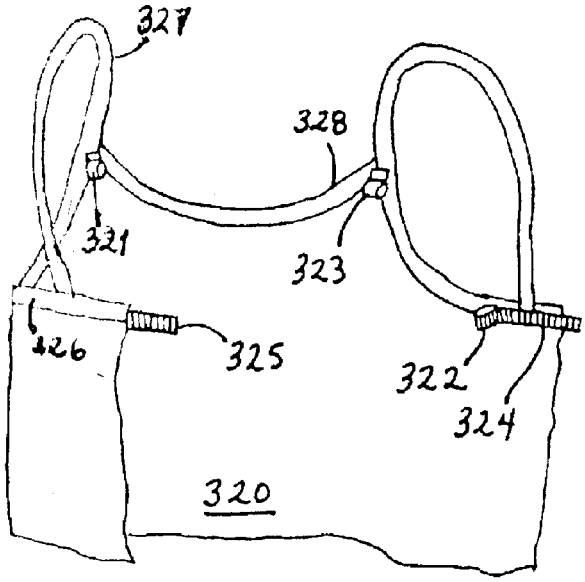
FIG. 29 shows another camisole configured for a removable bra portion.

FIG. 29 shows garment 320 configured for a removable bra portion. Garment 320 is a camisole with a continuous back, shown in cutaway form for convenience. Back band 325 is attached to the top of the interior of the back of garment 320, such as by stitching. Back band has fasteners 320 (not shown in FIG. 29) and 322 at its side edges, and fasteners 321 and 323 where neck 328 meets shoulder straps 327. Fasteners 320, 321, 322, 323 are adapted to couple with bra portion 230 in like manner as fasteners 220, 221, 222, 223 of FIG. 21. Back band 324 is formed of substantially the same elastic trim as bottom band 232 of bra portion 230.

Figure 30:
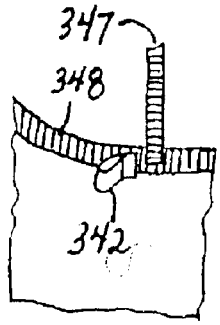
FIG. 30 shows a variation of the camisole of FIG. 29.

FIG. 30 shows a variation of the camisole of FIG. 29 in which shoulder straps 347 extend into back top strap 348, in similar manner as shoulder straps 327 and back top strap 326 of FIG. 29. However, in the variation of FIG. 30, shoulder straps 347 and back top strap 348 are formed of substantially the same elastic trim as bottom band 232 of bra portion 230. Accordingly, small fasteners 340 (not shown) and 342 are attached to the interior of back top strap 348 to function in corresponding manner as fasteners 320 and 322 of FIG. 29.

Figure 31:
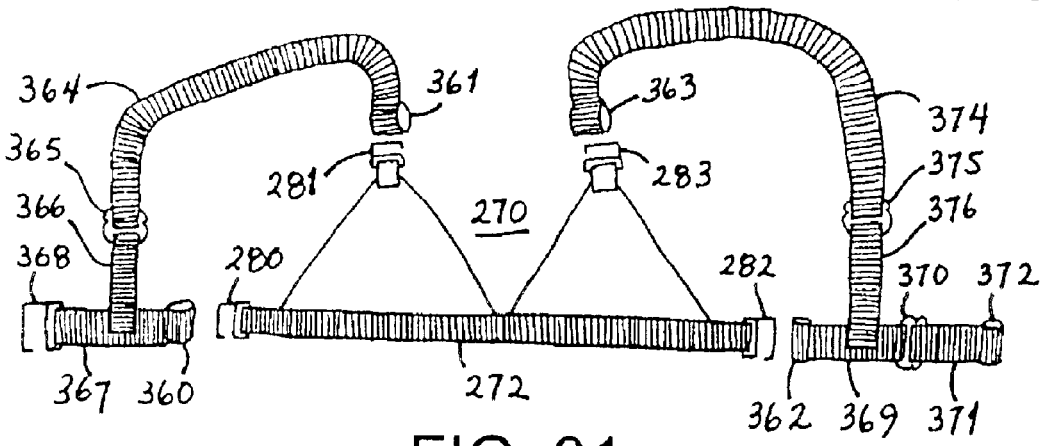
FIG. 31 shows strap portions for use with a bra portion.

FIG. 31 shows strap portions for use with a bra portion to create a conventional bra. Straps 364 and 374 are designed to pass over the shoulders of the wearer and terminate at bands 367 and 369, that form part of a back band when worn. In another embodiment, the strap portions can be configured to create a halter style bra. In another embodiment, the strap portions can be configured to create a low back bra, that is, the back bands form an X-shape across the wearer's back.

FIGS. 32–35 show different removable fastener configurations. Generally, the same fastener type will be used throughout the garment. In some embodiments, fastener types are mixed in one garment.

Figure 32:
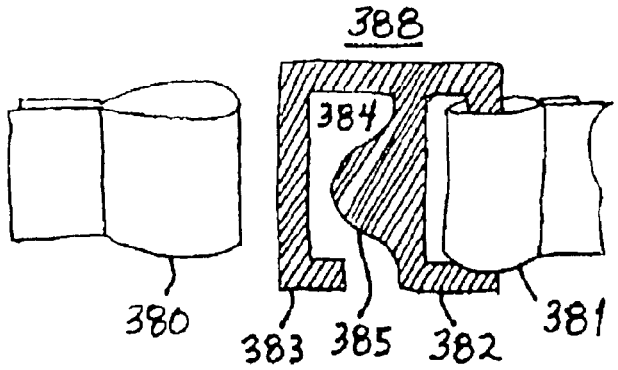
FIGS. 32–35 show different removable fastener configurations.

FIG. 32 shows the fastener configuration illustrated in the previously described embodiments. Loop 380 is placed on the inside of the outer garment. If the bra portion is not attached, loop 380 lays against the wearer's skin; since it lacks sharp edges, loop 380 does not cause significant discomfort. Hook 388 is typically made from metal, but could alternatively be formed from plastic.

Figure 33:
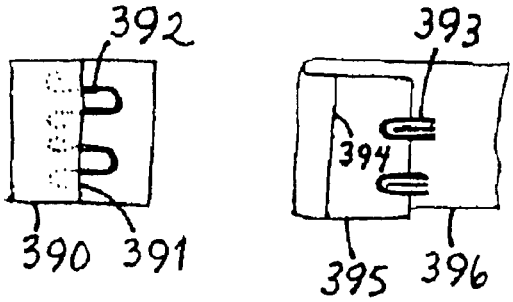

FIG. 33 shows eyes 392 for use inside the outer garment, and hooks 393 for use on the bra portion.

Figure 34:
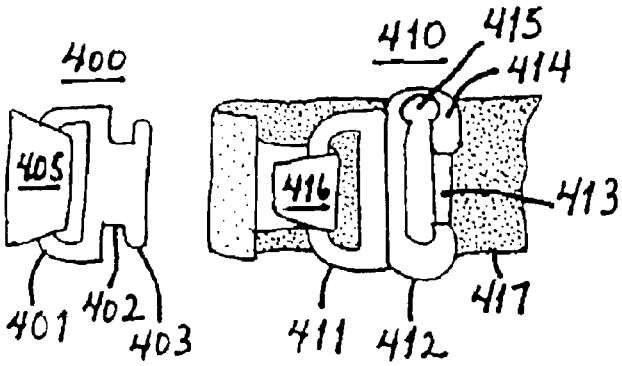

FIG. 34 shows a plastic snap-lock fastener having prong portion 400 on the inside of the outer garment, because it is smaller than receptacle portion 410 used on the bra portion. Protrusion 403 of prong portion 400 is inserted into aperture 415 of receptacle portion 410 and slid downwards until it encounters bottom rest 412, and then protrusion 412 is rotated until it encounters side rest 413 and snaps into a locked position. The insertion sequence is reversed to unlock portions 400 and 410.

Figure 35:
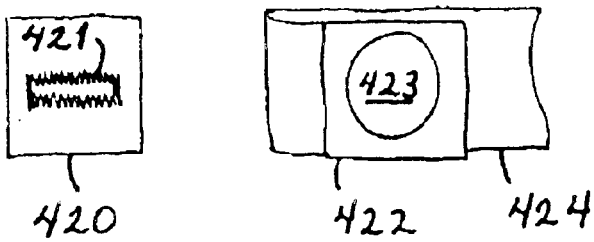

FIG. 35 shows buttonhole 421 used on the inside of the outer garment for coupling with button 423 used on the bra portion.

Although illustrative embodiments of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

What is claimed is:

1. A women's activewear garment comprising:

an outer garment having a back portion with side edges, back fasteners and a back band, the back fasteners being approximately at locations where the back band meets the side edges of the back portion, a bra portion having a bottom band with side edges and with bra fasteners at the side edges of the bottom band, the bra fasteners for coupling with respective ones of the back fasteners to create a continuous band around the chest of a wearer, the continuous band formed of the back band of the outer garment coupled to the bottom band of the bra portion, wherein the back band of the outer garment and the bottom band of the bra portion are formed of elastic material having substantially the same elasticity.

2. The activewear garment of claim 1, wherein the outer garment has a chest portion with a left side and a right side, and has top fasteners on the left and right sides of the chest portion, and the bra portion has a left cup and a right cup, and has cup fasteners at the tops of the left and right cups for coupling with the left and right side top fasteners.

3. The activewear garment of claim 2, wherein the outer garment has shoulder straps that couple behind the neck of the wearer.

4. The activewear garment of claim 2, wherein the outer garment has shoulder straps that extend over the wearer's shoulders and terminate at the back band.

5. The activewear garment of claim 1, wherein the bra portion has retaining pockets for cookie inserts.

6. The activewear garment of claim 1, wherein the bra portion includes underwires.

7. The activewear garment of claim 1, wherein the bra portion is a shelf bra.

8. The activewear garment of claim 1, wherein the back band is a visible part of the activewear garment when worn.

9. The activewear garment of claim 1, wherein the back band is an interior part of the activewear garment when worn.

10. The activewear garment of claim 1, wherein the back band is adjustable.

11. A women's activewear garment comprising:

an outer garment having shoulder straps, and having chest fasteners approximately at locations where the shoulder straps meet the front of the outer garment, a bra portion having cups, each cup having an outer edge an inner edge and a top point, the top point formed at the meeting of the outer edge and the inner edge, the cups having strap fasteners at the top points of the cups and cup bands along the outer and inner edges of the cups, the strap fasteners for coupling with respective ones of the chest fasteners, wherein the shoulder straps and the cup bands are formed of elastic material having substantially the same elasticity.

12. The activewear garment of claim 11, wherein the outer garment has a back portion with side edges, back fasteners and a back band, the back fasteners being approximately at locations where the back band meets the side edges of the back portion, and the bra portion has a bottom band with side edges and with bra fasteners at said side edges, the bra fasteners for coupling with respective ones of the back fasteners to create a continuous band around the chest of a wearer.

13. The activewear garment of claim 12, wherein the shoulder straps extend over the shoulders of a wearer and terminate at the back band.

14. The activewear garment of claim 11, wherein the shoulder straps couple behind the neck of the wearer.

15. The activewear garment of claim 11, wherein the bra portion has retaining pockets for cookie inserts.

16. The activewear garment of claim 11, wherein the bra portion includes underwires.

17. The activewear garment of claim 11, wherein the bra portion is a shelf bra.

18. The activewear garment of claim 11, wherein the shoulder straps are adjustable.

19. A bra for use with a garment, the garment having two interior upper fasteners, two interior lower fasteners and a back strap between the two interior lower fasteners, comprising:

a left cup and a right cup, the cups formed of stretchy material, each cup having an outer edge, an inner edge and a bottom edge, the bottom edge having a bottom band attached thereto, the outer and inner edges meeting at a top point, top fasteners at the top points of the cups for coupling with the interior upper fasteners of the garment, a left strap coupled to the bottom edge of the left cup and having a left side fastener, a right strap coupled to the bottom edge of the right cup and having a right side fastener, wherein the left and right side fasteners are for coupling with the interior lower fasteners of the garment so that the back strap of the garment, the left and right straps, and the bottom bands of the cups form a continuous band around a chest of a wearer of the garment.

* * * * *